United States Patent [19]

Fehlhaber

[11] 4,123,919

[45] Nov. 7, 1978

[54] REFRIGERATION FEED SYSTEM

[75] Inventor: Gustav James Fehlhaber, Burlingame, Calif.

[73] Assignee: NPI Corporation, Burlingame, Calif.

[21] Appl. No.: 818,844

[22] Filed: Jul. 25, 1977

[51] Int. Cl.[2] ..... F25B 43/00

[52] U.S. Cl. ..... 62/503; 62/525; 62/DIG. 2

[58] Field of Search ..... 62/503, 504, 524, 525, 62/220, DIG. 2; 137/593; 138/26

[56] References Cited

U.S. PATENT DOCUMENTS

| | | | |
|---|---|---|---|
| 2,345,714 | 4/1944 | Philipp | 62/503 |
| 2,503,212 | 4/1950 | Patterson | 62/DIG. 2 |
| 2,519,010 | 8/1950 | Zearfoss, Jr. | 62/504 |
| 3,664,150 | 5/1972 | Patterson | 62/503 |

*Primary Examiner*—Ronald C. Capossela
*Attorney, Agent, or Firm*—Lothrop & West

[57] ABSTRACT

A refrigeration feed system includes an accumulator adapted to contain liquid in its lower portion and to contain gas in its upper portion. A plurality of individual evaporators are arranged each at a different elevation above the accumulator. A pump withdraws liquid from the lower portion of the accumulator and pumps the liquid through a supply manifold to each one of the evaporators. There is a return manifold from each of the evaporators to the upper portion of the accumulator. Each evaporator has an upgoing pipe coming from the supply manifold and has a downgoing pipe going to the return manifold. A connecting device between the upgoing and downgoing pipes forms a weir disposed substantially at the elevation of the upper portion of the respective evaporator to which the manifold is connected. Liquid rising in the upgoing pipe can overflow into and mix with gas in the downgoing pipe and continue by gravital drainage back to the accumulator for recirculation. Each of the evaporators can thus be run flooded and with excess liquid automatically draining by gravity back to the accumulator. Substantially the same head or liquid pressure is maintained on each one of the individually disposed evaporators.

3 Claims, 1 Drawing Figure

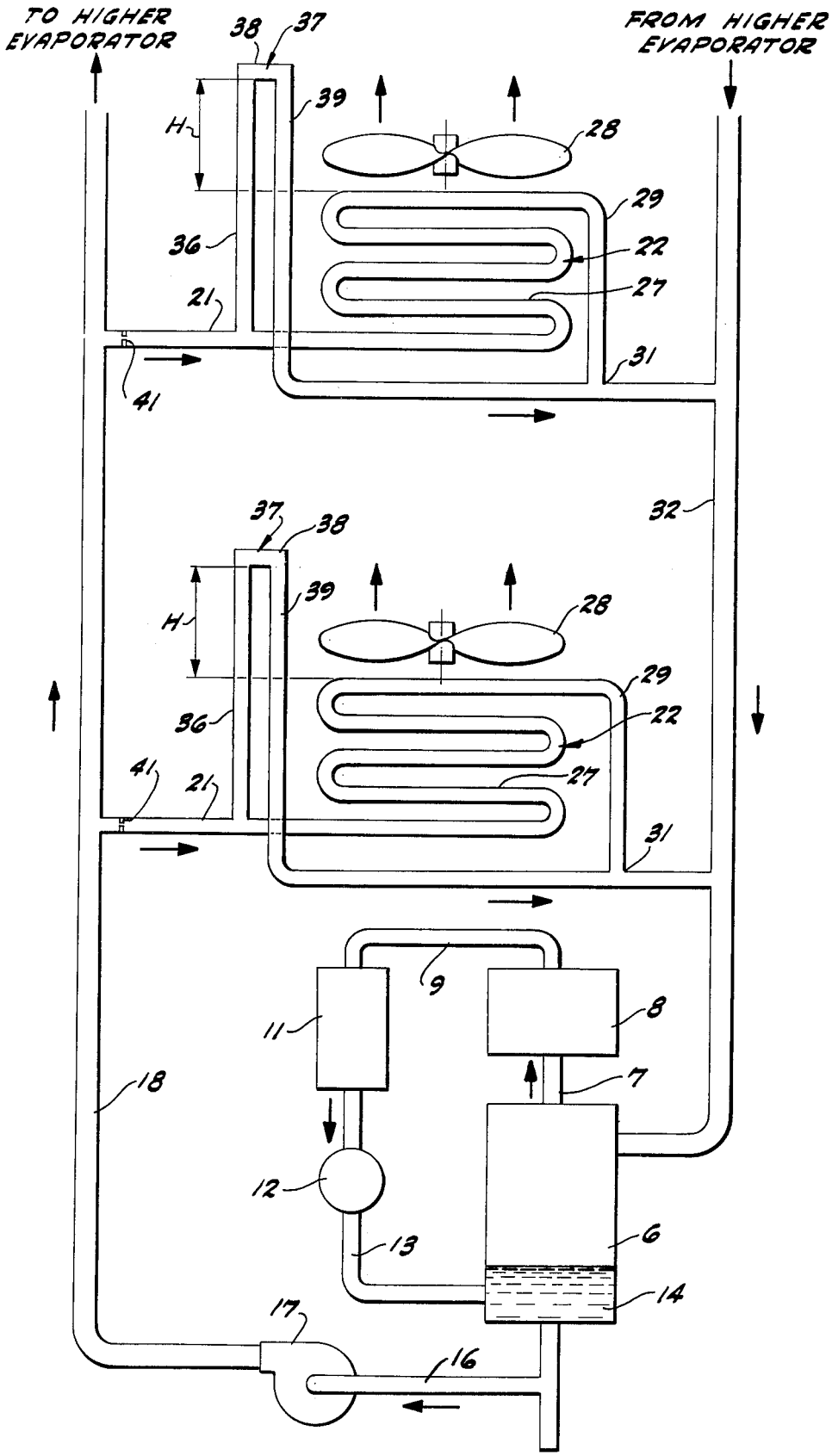
TO HIGHER EVAPORATOR
FROM HIGHER EVAPORATOR
38
37
39
H
28
29
36
22
27
21
31
41
32
37
38
39
H
28
29
36
22
41
21
27
31
9
11
8
7
18
12
13
6
14
17
16

REFRIGERATION FEED SYSTEM

BRIEF SUMMARY OF THE INVENTION

In the construction of a mechanical refrigeration system, it is customary to have a compressor discharge a refrigerant into a condenser, from which the refrigerant travels through a pressure reducing valve and enters into an accumulator. The accumulator contains refrigerant in liquid form at the bottom and in gaseous form at the top. The liquid is pumped out of the bottom portion of the accumulator into an evaporator, wherein the liquid refrigerant absorbs heat and changes back into gas form and is returned to the upper portion of the accumulator. From there the refrigerant gas then returns to the compressor for recycling. It is highly advantageous to run the evaporator quite full of refrigerant in order that all of the heat transfer surface therein will be utilized. It is customary to flood the evaporator and to permit excess liquid refrigerant to flow back to the accumulator to make sure that all of the effective surface of the evaporator is wetted by the liquid refrigerant.

There is difficulty, however, when a number of evaporators are utilized in the same system and the individual evaporators are disposed at different elevations so that each one of them is subject to a different hydraulic head. Pursuant to this invention there is afforded an arrangement for pumping liquid from the accumulator through an upgoing or upwardly extending manifold pipe having branches to each of the differently elevated evaporators. A weir is provided at each of the evaporators. Each weir overflows substantially at the nominal elevation of its related evaporator. Liquid refrigerant flows into each evaporator under substantially the same head as it does in all of the other evaporators. Excess liquid flows back by gravity through a return pipe and manifold to the accumulator. In this way, despite differences in elevation of the different evaporators, each one of them is treated substantially the same way with refrigerant under substantially the same head pressure at each evaporator.

BRIEF DESCRIPTION OF THE SEVERAL VIEWS OF THE DRAWING

The drawing is a diagrammatic showing of a refrigeration feed system pursuant to the invention, illustrating a number of evaporators situated at different elevations and included in a related refrigeration system.

DETAILED DESCRIPTION

In a particular refrigeration system, there is provided an accumulator vessel 6 such as an enclosure having a substantial vertical dimension. An outlet connection 7 goes from the upper portion of the accumulator into the customary mechanical refrigeration compressor 8. Refrigerant gas from the accumulator flows through the pipe 7 and is compressed in the compressor 8 and is discharged in compressed form through a duct 9 leading into a condenser 11. Therein the compressed gas is cooled and liquified.

The liquified refrigerant flows through a pressure reducer 12 and then travels through a duct 13 into the bottom of the accumulator 6 to join a body 14 of liquid refrigerant therein. A pipe 16 takes liquid from the accumulator to a pump 17 wherein the pressure is raised. A manifold 18 extends upwardly from the pump and has a number of connections 21 at different elevations each going to a respective one of a number of heat exchangers 22 or evaporators disposed at the different elevations, usually one above another. At each evaporator 22 the connecting pipe 21 goes into the interior of the local evaporator 22 and connects with the heat exchange surfaces 27 thereof. The refrigerant absorbs heat from air passing over the surfaces 27 by operation of fans 28 in the customary fashion. The refrigerant in going through the heat exchange surfaces 27 and in absorbing heat changes from its initially liquid form into a gas form with perhaps some entrained liquid. Each heat exchanger or evaporator 22 is provided with a connecting pipe 29 having a junction 31 to a return manifold 32. This extends downwardly and is for carrying gas and any entrained liquid by gravity back to the upper portion of the accumulator 6. Any liquid droplets fall out by gravity and join the pool of liquid below the level of the liquid 14. The remaining, returned gas, freed of liquid, is available at the top of the accumulator for outflow again through the connector 7 to the compressor for recycling.

Particularly pursuant to this invention, a special arrangement is provided for making sure that the flow of liquid from the individual pipes 21 into the evaporators 22 at each of the several elevations is always under substantially the same head or pressure. This is despite the fact that the heat exchange surfaces themselves are at different elevations. For this reason, each pipe 21 is provided with an upwardly extending branch 36. This goes to an elevation at least as high as or perhaps slightly above the top of the evaporator heat exchange surfaces 27. The desired individual or local head or pressure can thus be exerted on the liquid therein.

The upwardly extending pipe 36 is actually part of or constitutes a weir 37. This is preferably formed by a horizontal connecting pipe 38 having an overflow portion likewise connected to a downwardly extending pipe 39 joining the connection 31 to the return manifold 32 and so subject to the low gas pressure therein. Since there is a freely open gas connection between the upper portion of the accumlator and the connectors 38 through the joined pipes, each horizontal connector 38 establishes a height or elevation above which the liquid column in the adjacent upwardly extending pipe 36 cannot rise. That sets or establishes the head or pressure of the liquid to exactly that due to the distance of the weir 37 above the upper portion of the heat exchange surface 27. There is thus a predetermined head or pressure H imposed on each heat surface despite the pressure of the liquid that is pumped into the related pipe 21. Thus the evaporator can always run flooded, as desired, but cannot be over-pressured by the liquid.

Since the operating characteristics of the evaporators are known and in order to avoid excess size of pipe, there is usually put into each pipe 21 just downstream of the manifold an orifice 41. This permits some pressure difference between the manifold 18 and the pipe 21 so that there can easily be flow upwardly of the pipe 18 to the next higher evaporator, as shown in the figure.

It is sometimes the case that the load on each of the successive evaporators changes from time to time. If so, the orifice 41 can be furnished by a balancing or adjusting valve. This amounts to a variable or adjustable orifice. This orifice or valve is not intended as a metering device, but is a restriction so that the pump 17 can drive liquid up to the uppermost evaporator 27 without overpowering the lower evaporators.

With this system, the head H on the lower evaporator is exactly duplicated by a similar head on each of the upper evaporators, all of the heads or pressures being the same and all of the generally identical evaporators running flooded under the same initial operating pressure. If by chance there is any excess refrigerant liquid supplied to any one evaporator, the excess simply overflows the individual weir 37 and returns freely by gravity to the upper portion of the accumulator 6.

It is possible, of course, to arrange matters so that different evaporators have different pressures or heads upon them. That is easily done by changing the height of any one of the individual weirs to afford a different head pressure. Usually, however, this is not required, and a large installation is made up of a number of identical evaporators and a number of identical weirs.

I claim:

1. A refrigeration feed system comprising an accumulator adapted to contain liquid in its lower portion and gas in its upper portion, a plurality of evaporators each disposed at a different elevation, a pump, means for connecting the inlet of said pump to the lower portion of said accumulator, pipe means for connecting the outlet of said pump to the inlet of each of said evaporators, means for connecting the outlet of each of said evaporators to the upper portion of said accumulator, and a plurality of weirs incorporated in said pipe means one for each of said evaporators, each of said weirs being disposed at an elevation substantially above the top of its respective evaporator.

2. A device as in claim 1 including an upwardly extending liquid pipe communicating with liquid in said accumulator, a downwardly extending gas pipe communicating with gas in said accumulator, and means establishing a liquid and gas connection between said gas pipe and said liquid pipe substantially at a predetermined elevation above said accumulator.

3. A device as in claim 1 in which said means for connecting the outlet of each of said evaporators to the upper portion of said accumulator is disposed to provide a downward gravital path to said accumultor for liquid overflowing said weirs.

* * * * *